US008925291B2

(12) United States Patent
Kern

(10) Patent No.: US 8,925,291 B2
(45) Date of Patent: Jan. 6, 2015

(54) DEVICE FOR INSERTING SHEETS INTO AN ENVELOPE

(71) Applicant: Kern Investment Consulting Management Ltd., Guernsey (GB)

(72) Inventor: Marc Kern, Münsingen (CH)

(73) Assignee: Kern Investments Consulting Management Ltd., Guernsey (GB)

( * ) Notice: Subject to any disclaimer, the term of this patent is extended or adjusted under 35 U.S.C. 154(b) by 0 days.

(21) Appl. No.: 14/144,042

(22) Filed: Dec. 30, 2013

(65) Prior Publication Data

US 2014/0203491 A1 Jul. 24, 2014

(30) Foreign Application Priority Data

Jan. 21, 2013 (EP) ..... 13405004

(51) Int. Cl.
*B43M 3/04* (2006.01)

(52) U.S. Cl.
CPC *B43M 3/04* (2013.01); *B43M 3/045* (2013.01)
USPC ..... 53/460; 53/381.7; 53/569; 271/2

(58) Field of Classification Search
CPC ..... B43M 3/045; B43M 3/04
USPC ..... 271/2; 53/460, 381.7, 569, 492
See application file for complete search history.

(56) References Cited

U.S. PATENT DOCUMENTS

| | | | | |
|---|---|---|---|---|
| 3,785,256 | A | 1/1974 | Nikkel | |
| 5,251,425 | A | 10/1993 | Kern | |
| 8,201,387 | B2 * | 6/2012 | Passoni | 53/460 |
| 8,590,280 | B2 * | 11/2013 | Passoni | 53/460 |
| 2007/0040316 | A1 | 2/2007 | Kern | |

FOREIGN PATENT DOCUMENTS

| | | | |
|---|---|---|---|
| EP | 0 504 114 | B1 | 7/1995 |
| EP | 1 304 305 | A2 | 4/2003 |
| WO | WO 94/27832 | A1 | 12/1994 |
| WO | WO 2004/098905 | A1 | 11/2004 |
| WO | WO 2010/118001 | A2 | 10/2010 |

* cited by examiner

*Primary Examiner* — Luis A Gonzalez
(74) *Attorney, Agent, or Firm* — Birch, Stewart, Kolasch & Birch, LLP

(57) ABSTRACT

A device for inserting sheets into an envelope comprises a holding device supporting the envelope. A support portion of the holding device is inserted into the envelope. The support portion has a fixed orientation and position relative to a feed device. The device further comprises a mechanism for preparing the envelope for accommodating the support portion of the holding device. The mechanism is upstream of the holding device and comprises a first interaction device, acting onto the envelope in a first direction during feeding of the envelope and a second interaction device downstream of the first interaction device, acting onto the envelope in a second, opposite direction. The second interaction device comprises at least one cam on a rotatable shaft. By rotation the shaft and cam may be brought into an interaction position, with the envelope, or an inactive position.

15 Claims, 4 Drawing Sheets

DEVICE FOR INSERTING SHEETS INTO AN ENVELOPE

TECHNICAL FIELD

The invention relates to a device for inserting sheets into an envelope comprising a holding device for supporting the envelope during insertion of the sheets into the envelope, when a support portion of the holding device is inserted into the envelope in between a front side of the envelope and a back side of the envelope, and further comprising a feed device for feeding the envelope to the holding device, wherein the support portion of the holding device has a fixed orientation and position relative to the feed device and maintains this fixed orientation during feeding of the envelope, insertion of the sheets and removing of the envelope respectively. The invention further relates to a method for inserting sheets into an envelope.

BACKGROUND ART

In the case of mass dispatch of printed matter, such as, for example, brochures, advertising mail, invoices or bank statements, a large number of sheets have to be reliably inserted into envelopes in the shortest possible time. In this case, both the quantity and type of sheets which are to be inserted and therefore the thickness of a filled envelope and also the format of the envelope may vary between different dispatch tasks.

Devices for automatically inserting sheets into envelopes are already known from the prior art.

As an example, EP 0 504 114 B1 (Kern AG) shows a device, in which the flap of the envelope is opened by a rotating member and the envelope is fed along a feed direction of a packaging pocket by rotating members. In the process, a holding-down roller is lowered in order to somewhat open the envelope, and the packaging pocket is pivoted in the feed direction counter to the envelope, so that the envelope can be at least partially pulled onto the packaging pocket. The sheets to be inserted are then conveyed by transport elements into the packaging pocket and therefore into the envelope, and the packaging pocket is finally pivoted back in the removal direction, so that the envelope can be pulled off from the packaging pocket and conveyed on further.

The pivoting movements of the packaging pocket, which are necessary in order to move the pocket from the feed direction into the removal direction, require a certain amount of time and therefore slow down the process. Moreover, the pivotable pocket tends to "flutter" at high processing speeds, which makes its monitoring difficult and in turn limits the maximum speed and therefore the efficiency. Finally, it requires a complicated mechanical construction of the device.

Accordingly, it has been proposed in WO 2004/098905 A1 (Kern Investment Consulting Management Ltd.) to have a non-pivoting packaging pocket. The empty envelope is fed to the pocket along a feed direction and removed from the pocket along a removal direction, whereas the angles between the feed direction and the pocket, and the removal direction and the pocket are fixed but different from each other. For feeding the envelope to the pocket, a guide element with a discharge point, the guide element being convex at the discharge point, has been proposed, such as a guide plate with a vacuum device or a rotatable vacuum drum.

This proposed device is advantageous insofar as flutter of the holding device is avoided, allowing for higher processing speeds. Furthermore, using a convex guide element avoids obstruction of the removal part of the envelope. However, feeding the envelope to the holding device is a crucial step in the insertion process. Especially if high speeds shall be achieved, the known devices require careful adjustment, in particular after changing the type of processed envelopes.

SUMMARY OF THE INVENTION

It is the object of the invention to create a device and a method for inserting sheets into an envelope pertaining to the technical field initially mentioned, that allow for high processing speeds and minimize adjustment needs.

The solution of the invention is specified by the features of claims 1 and 13. According to the invention, the device comprises a mechanism for preparing the envelope for accommodating the support portion of the holding device, the mechanism being arranged upstream of the holding device. The mechanism comprises a first interaction device, acting onto the envelope in a first direction during feeding of the envelope. It further comprises a second interaction device arranged downstream of the first interaction device, acting onto the envelope in a second direction during feeding of the envelope, the second direction being essentially opposite to the first direction. The second interaction device comprises at least one cam on a rotatable shaft, wherein by rotation of the shaft the at least one cam may be brought into an interaction position, where the cam interacts with the envelope, and into an inactive position, where the cam does not interact with the envelope.

The inventive method comprises the steps of:

a) feeding the envelope in a feed direction;
b) during feeding of the envelope acting onto the envelope in a first direction by a first interaction device;
c) rotating a rotatable shaft of a second interaction device, the shaft having at least one cam, into an interaction position, the rotational shaft being arranged downstream of the first interaction device;
d) during feeding of the envelope acting onto the envelope by the cam in a second direction, the second direction being essentially opposite to the first direction;
e) further feeding the envelope such that a support portion of a holding device is inserted into the envelope in between a front side of the envelope and a back side of the envelope;
f) rotating the shaft of the second interaction device such that the at least one cam does not interact with the envelope anymore; and
g) after filling of the envelope removing the envelope from the holding device in a direction essentially opposite to the feed direction.

In the context of this disclosure, the terms "upstream" and "downstream" relate to the feed direction of the envelope to the holding device, i.e. a first element that is upstream from a second element is reached first by the leading edge of the envelope, during the feeding of the envelope to the holding device.

The "front side" of the envelope is that one of the two main surfaces of the envelope which features the flap when the envelope is in its open state. For closing the envelope, the flap will be folded by 180° and affixed to the "back side" of the envelope.

It is to be noted that the support portion of the holding device supports the envelope during at least part of the filling process. For that purpose, the envelope is transported onto the holding device until the support portion is inserted between the front and the back side of the envelope. The filling of the particular envelope will not start before the envelope is at least partly supported by the holding device. This kind of holding device ("pocket") ensures reliable support for the envelope. However, while advantageous, it is not always required that the envelope is supported during the complete filling process, i.e. until the sheets have reached their final position with respect to the envelope.

Due to the fact that the holding device is non-pivoting, fluttering of the holding device is avoided. In particular, it is preferred that the orientation and position of the holding device is fixed while the inventive device is running.

The two interaction devices act onto the envelope during feeding of the envelope. They do not need to interact with the envelope during the entire feeding step, i.e. up to the moment when the envelope has reached its final position with respect to the holding device, but the may interact with the envelope only in particular phases of the feeding.

Due to the inventive arrangement of the interaction devices and the holding device, the travelling path of the envelope is successively influenced by the first interaction device, the second interaction device and the holding device. In particular, the device is controlled such that in a certain time interval all these elements interact with the envelope. This means that along the feed direction the envelope is exposed to three forces, the first and third force being directed in the first direction, the second force, exerted in a region lying between the regions where the first and third force are acting, being directed in the second direction. This leads to a particular deformation of the envelope. It has been found that this particular deformation significantly facilitates the feeding of the envelope onto the holding device.

In principle, the at least one cam may have different geometries. In a plane perpendicular to the shaft axis, it may have the cross-section of a segment, it may be pin like or have any other form which allows for bringing the cam into an interaction position, and out of engagement, respectively, by rotating the shaft. The same holds true for the geometry along the shaft: The cross-section may be constant or varying. The axial length of the cam may be comparable to that of the shaft (i.e. a single cam interacting with essentially the whole width of the envelope) or a plurality of cams may be arranged on the shaft. In particular, the rotation axis of the shaft is oriented perpendicular to the feed direction.

The inventive interaction devices mechanically interact with the envelope, ensuring a clearly defined impact on the travel path and deformation of the envelope. The envelope is deformed in such a way that the open side of the envelope (i.e. the one to be closed by the flap later on) is opened up, ready to receive the holding device. At the same time, vacuum devices and the corresponding adjustment needs are avoided. The rotational movement of the shaft of the second interaction device avoids rapidly oscillating elements and the corresponding vibrations. All of this allows for high processing speeds, reduced vibrations and noise and simple adjustment.

It has also turned out that the inventive layout of the interaction devices and the holding device is suitable for successfully feeding a variety of envelope formats and envelope types, thus drastically reducing the need for (re-)adjustments.

Preferably, the first interaction device has a fixed orientation and position relative to the feed device and the support portion of the holding device during feeding of the envelope, insertion of the sheets and removing of the envelope respectively. In particular, the holding device and the first interaction device are both fixed and non-moved during operation of the device. Thereby, the construction and the operation of the device are simplified, the costs are reduced and the durability is improved.

Alternatively, the first interaction device is moved, especially in order to vary its impact onto the envelope during different phases of the feeding and/or in order to avoid obstruction when removing the filled envelope from the holding device.

Preferably, the first direction is essentially perpendicular to a main surface of the fed envelope and points to the front side of the envelope. Accordingly, the second direction is also essentially perpendicular to the main surface of the fed envelope and points to the back side of the envelope. It has been found that this particular orientation of the forces allows for a particularly easy feeding of the envelope onto the holding device, taking into account the particular challenge of feeding the flap only in a first phase of interaction between the envelope and the holding device.

Alternatively, the forces are opposite to the preferred embodiment or angled with respect to the main surface of the envelope.

Preferably, an interaction region of the at least one cam of the second interaction device extends over essentially the whole maximum width of envelopes processed with the device. This avoids the need for adjustment when differently sized envelopes shall be processed. Thereby, not only the time needed for adjustment is spared but the construction of the device is simplified as no adjustable cams are needed.

Preferably, the at least one cam of the second interaction device comprises a plurality of spaced cams. These spaced cams are arranged along the shaft and ensure the needed interaction with the envelopes. Using a plurality of spaced cams allows for reducing the weight of the moved part of the second interaction device, allowing for higher dynamics and reducing the amount of vibration.

Alternatively, a single cam is used, wherein this single cam preferably extends over the whole maximum width of the envelopes processed.

Advantageously, the device features a guide plate comprising a plurality of slots, the guide plate and the second interaction device arranged such that the plurality of spaced cams penetrate the plurality of slots in the interaction position. This allows for reliably supporting the envelope in particular during intervals when the second interaction device does not interact with the envelope such as during removal of the envelope.

Alternatively, support of the envelope is effected upstream and/or downstream of the second interaction device.

In a preferred embodiment, the mechanism for preparing the envelope comprises a third interaction device arranged downstream of the first interaction device, acting onto the envelope in the first direction, wherein the third interaction device may be brought into an interaction position, where it interacts with the envelope, and into an inactive position, where it does not interact with the envelope. Whereas the third interaction device is downstream of the first interaction device it may be upstream or downstream with respect to the second interaction device. It may also be essentially opposite the second interaction device, i.e. at essentially the same position with respect to the feed path of the envelope.

The third interaction device allows for mechanically guiding the flap of the envelope such that it passes the upstream end of the holding device without interference. Essentially this has nothing to do with holding open the envelope for inserting the holding device as there is a first phase of feeding the envelope to the holding device when only the flap overlaps with the holding device and opening the envelope is not yet required. Due to the comparatively large flexibility of the flap with respect to the rest of the envelope an additional interaction device ensures reliable control even during this first phase.

Accordingly, the inventive device may have essentially three operating positions:

1st position: The third interaction device interacts with the envelope in order to guide the flap, the second interaction device does not interact with the envelope;

2nd position: the second interaction device interacts with the envelope in order to open the envelope for feeding the envelope to the holding device;

3rd position: neither the second nor the third interaction device interact with the envelope such that the envelope may be freely fed to and removed from the holding device.

Alternatively, there is no third interaction device and the envelope is held open already for avoiding interference between the flap and the holding device. Whereas this is usually possible for short flaps it may be a challenge for longer flaps, where the embodiment having the additional third interaction device is preferred.

Preferably, the third interaction device is operated as follows:

a) prior to a downstream end of the envelope (including the flap) contacting the support portion of the holding device, the third interaction device acts onto the envelope in the first direction; and b) after a downstream end of the envelope has contacted the support portion of the holding device and prior to the rotatable shaft of the second interaction device having reached the interaction position, the third interaction device is positioned in an inactive position, where it does not interact with the envelope.

It is to be noted, that rotating the rotatable shaft of the second interaction device and positioning the third interaction device in the inactive position may happen simultaneously.

In a preferred embodiment, the third interaction device comprises at least one cam on a rotatable shaft, wherein by rotation of the shaft the cam may be brought from the inactive position into the interaction position. The rotational movement of the shaft of the third interaction device avoids rapidly oscillating elements and the corresponding vibrations. This allows for high processing speeds with reduced noise and simple adjustment.

In other embodiments, the third interaction device may comprise oscillating elements. Generally, the dynamics of the movement of the third interaction device are smaller than those of the movement of the second interaction device, accordingly at least in a certain range of processing speeds an oscillating third interaction device is compatible with certain requirements as to noise and vibrations but not an oscillating second interaction device.

Preferably, the holding device comprises at least two lateral blades for supporting the envelope in lateral edge regions thereof. This allows for a reliable support of the envelope while having a simple and lightweight holding device.

Advantageously, the at least two lateral blades are adjustable in a cross direction in order to adapt the device to envelopes of different dimensions. This avoids the need for replacing the entire holding device if envelopes of different sizes are to be processed, thus minimizing the time required for adjusting the device to a new envelope format.

Alternatively, the blades are fixed and replaced if envelopes of different widths are to be processed.

Generally, the length of the holding device (along the feed direction) is such that envelopes of all possible lengths may be supported. Together with having a holding device with an adjustable width, this allows for processing all possible envelopes without having to replace the holding device.

Preferably, the holding device further comprises a third central blade for supporting the envelope in a central region. This ensures a controlled guidance and support of the envelope and thus a controlled deformation in cooperation with the first and second interaction devices.

In particular, preferably the lateral blades and the central blades each comprise a main portion, the blades being arranged such that the main portions are arranged essentially in a common plane, and in that the lateral blades each comprise a separation part extending from the main portion in the second direction, and in that the central blade comprises a separation part extending from the main portion in the first direction.

The corresponding forces acting on the envelope from its inside and the forces acted on the envelope from its outside, by the interaction devices, reliably deform the envelope such that it may be rapidly fed onto the holding device, avoiding any undesired interference.

Instead of the blades a continuous element extending from one side to the other may be employed. This element may as well accomplish the function of the third blade.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

Figure 1:
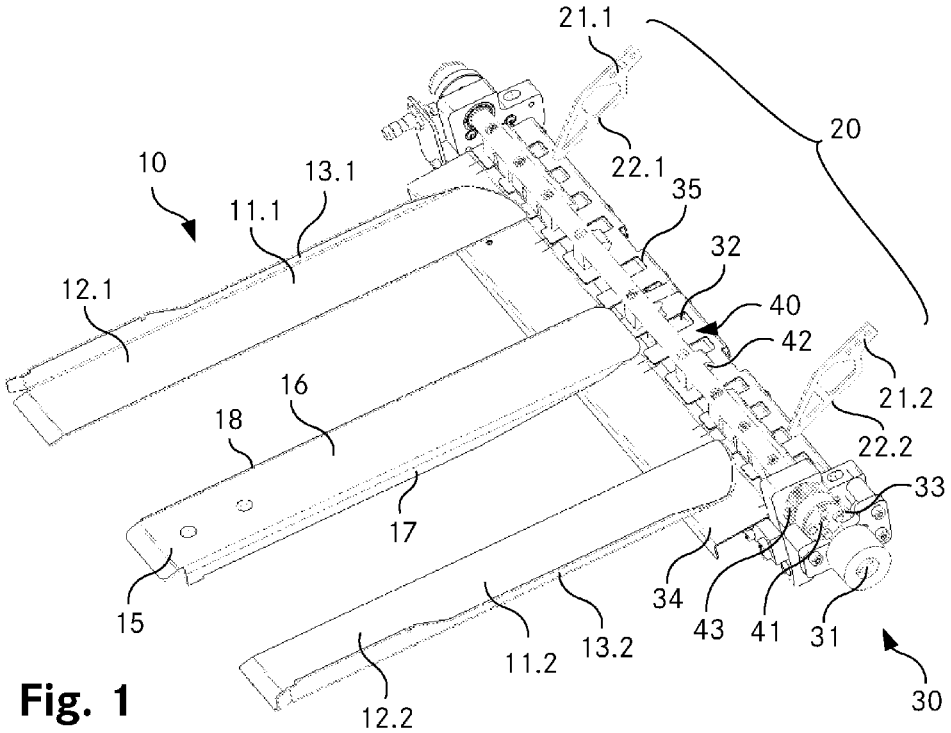
FIG. 1 a perspective view of an embodiment of an inventive device for feeding an envelope to a holding device.
Figure 2:
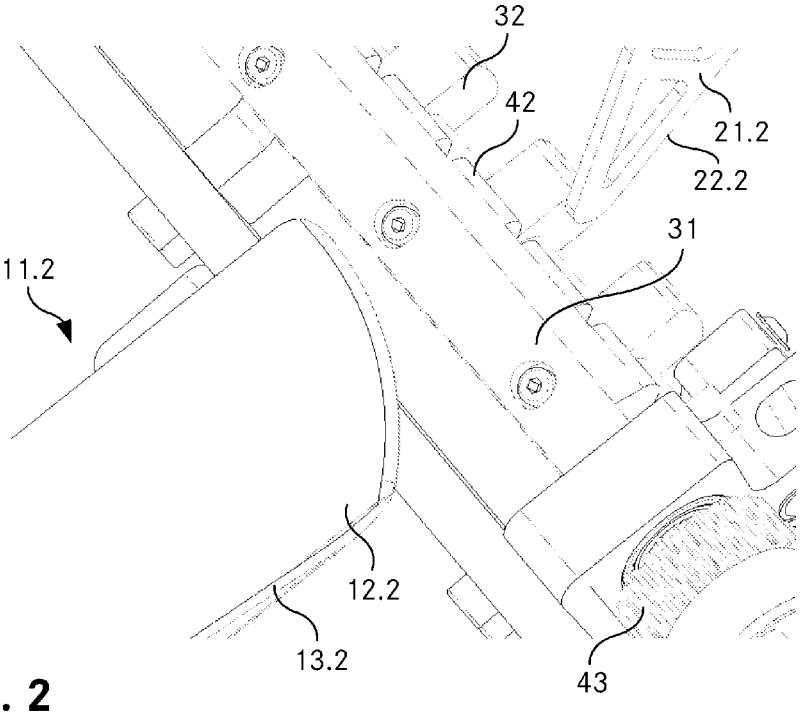
FIG. 2 a detailed perspective view of the embodiment of FIG. 1, showing the vicinity of a free end of a blade of the holding device.
Figure 3:
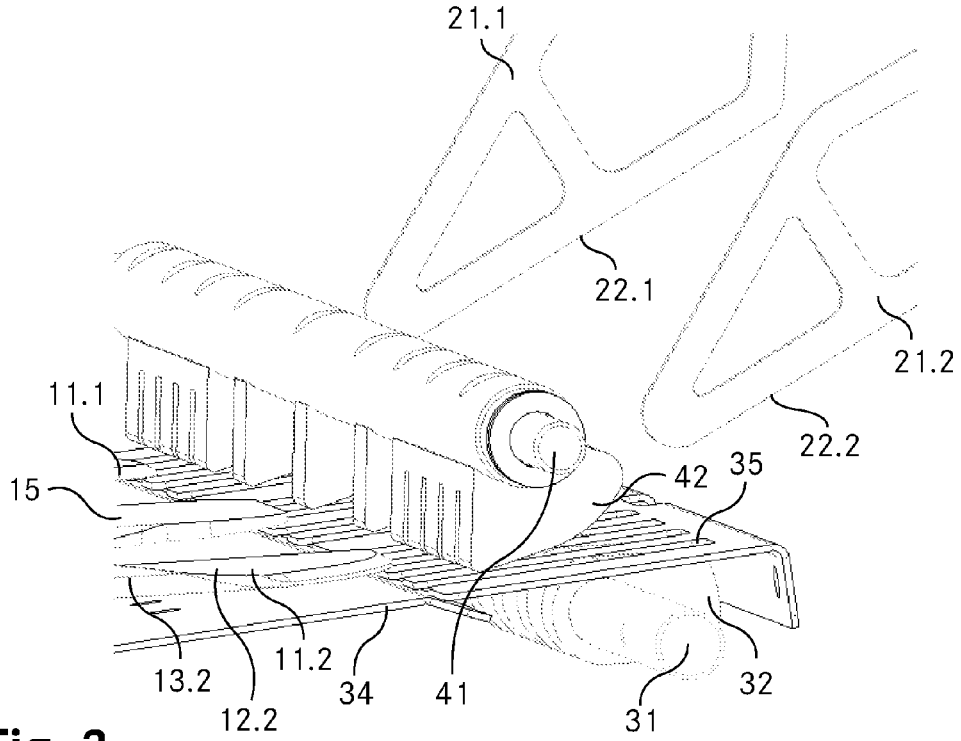
FIG. 3 a further detailed perspective view of the embodiment of FIG. 1, showing the interaction devices.
Figure 4:
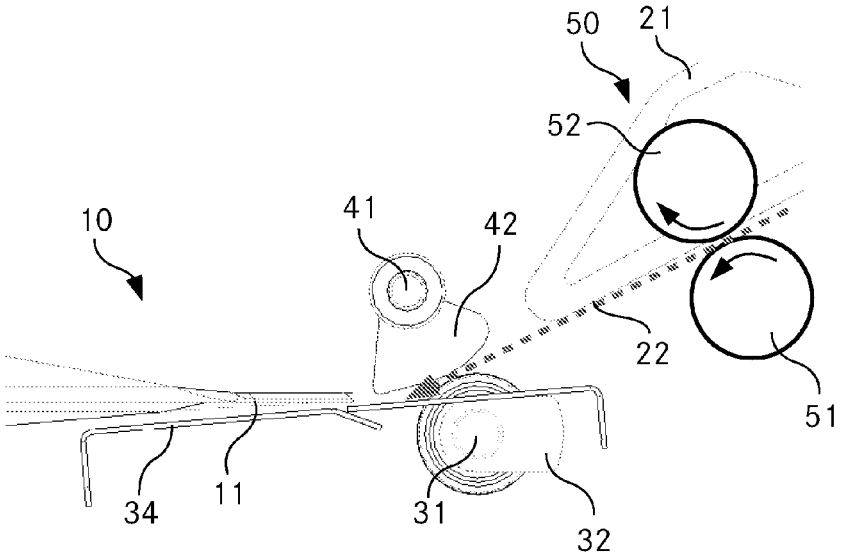
FIG. 4 a partial side view of the embodiment of FIG. 1 including a schematical representation of a feed device.

FIG. 1 is a perspective view of an embodiment of an inventive device for feeding an envelope to a holding device. FIG. 2 is a detailed perspective view of the embodiment of FIG. 1, showing the vicinity of a free end of a blade of the holding device. FIG. 3 is a further detailed perspective view of the embodiment of FIG. 1, showing the interaction devices. FIG. 4 is a partial side view of the embodiment of FIG. 1.

The holding device 10 comprises of two lateral blades 11.1, 11.2 which are reversed left to right, and of a central blade 15 arranged in a central position between the two lateral blades 11. The main extension of the three blades 11, 15 is in a feed direction. The blades 11, 15 are attached to a machine frame (not shown), the two lateral blades 11 being adjustable in a direction perpendicular to the feed direction in order to adapt the holding device 10 to the dimensions of the envelopes to be processed. The geometry of the blades 11, 15 is described in more detail below.

The inventive device further comprises a first interaction device 20 comprising of two guide fingers 21.1, 21.2 having a main surface extending along the feed direction. The form of the guide fingers 21 is essentially that of a prism the base of which having the shape of a trapeze. For reducing the weight of the guide fingers 21.1, 21.2 their main surface has an open-work geometry. The longer of the parallel edges of the trapeze of the guide fingers 21.1, 21.2 is a guide edge 22.1, 22.2 terminating in a rounded corner facing the free ends of the blades 11.1, 11.2. Similar to the lateral blades 11.1, 11.2, the guide fingers 21.1, 21.2 may be adjustable in a direction perpendicular to the feed direction in order to adapt the first interaction device 20 to the dimensions of the envelopes to be processed.

A second interaction device 30 comprises a rotatable shaft 31, a number of cams 32 being affixed thereto. A guide plate 34 is arranged adjacent to the shaft 31, in such a way that the guide fingers 21 as well as the blades 11, 15 are arranged on a first side of the guide plate 34, whereas the shaft 31 is arranged on a second side of the guide plate 34. Depending on the rotational position of the shaft 31, the cams 32 penetrate slots 35 of the guide plate 34.

As can be seen from FIGS. 1 and 3, four cams 32 each are arranged on the shaft 31 in the regions adjacent to the ends of the shaft. Further four cams 32 are arranged in a central region of the shaft 31. Basically, the lateral regions correspond to the possible positions of the lateral blades 11.1, 11.2, whereas the central region corresponds to the position of the central blade 15. This design ensures that the impact on the processed envelopes is always precisely defined, in particular in the inlet regions of the blades 11, 15. It is not required to adjust the cams 32 or to replace the shaft 31 in order to adapt the device to different envelope widths. By having a certain number of cams 32 cooperating with the corresponding number of slots 35 in the guide plate 34, it is ensured that the envelope is reliably guided by the cams 32 or the guide plate 34, respectively, depending on the rotational position of the cams 32.

A third interaction device 40 comprises a further rotatable shaft 41, a number of cams 42 being affixed thereto. With respect to the rotatable shaft 31 of the second interaction device 30, the further rotatable shaft 41 of the third interaction device 40 is arranged on the opposite side of the plane defined by the main surfaces of the blades 11, 15 of the holding device 10. The two shafts 31, 41 of the second and third interaction device 30, 40 are mechanically coupled by intermeshing gears 33, 43.

Again, as can be seen from FIGS. 1 and 3, four cams 42 each are arranged on the shaft 41 in the regions adjacent to the ends of the shaft. Further three cams 42 are arranged in a central region of the shaft 41. The mutual distance between the cams 42 in the lateral regions is smaller than the mutual distance between the cams 42 in the central region. Basically, the lateral regions correspond to the possible positions of the lateral blades 11.1, 11.2, whereas the central region corresponds to the position of the central blade 15. This design ensures that the impact on the processed envelopes is always precisely defined, in particular in the inlet regions of the blades 11, 15. It is not required to adjust the cams 42 or to replace the shaft 41 in order to adapt the device to different envelope widths.

The two lateral blades 11.1, 11.2 of the holding device 10 comprise a main part 12.1, 12.2 of a generally rectangular shape, the free end of which, facing the interaction devices 20, 30, 40, having a rounded edge such that the leading edge of an envelope fed to the holding device 10 first contacts the innermost part of the blade 11. The outer edge of the blade 11 is provided with a ridge 13.1, 13.2, extending perpendicular to the main part 12.1, 12.2 in the direction facing the first and third interaction devices 20, 40. Starting from the free end of the lateral blades 11, the height of the ridge 13 gradually increases to a first height. After a section of constant height which extends along about 60% of the length of the lateral blade 11, a transition to a second height follows, followed by a further section of constant height.

The central blade 15 comprises a main part 16 of a generally rectangular shape, the corners of the free edge are rounded. Both outer edges of the blade 15 are provided with a ridge 17, 18, extending perpendicular to the main part 16 in the direction facing the second interaction device 30, i.e. opposite to the ridges 13 of the lateral blades 11. Starting from the free end of the central blade 15, the height of the ridges 17, 18 gradually increases to a certain height. A section of constant height extends along the rest of the length of the central blade 15.

The FIG. 4 includes a schematical representation of a feed device 50 comprising of a roller 51 and a number of pulleys 52 rotating in opposite directions such as to feed the envelope to the holding device 10 in a fashion known as such. The device for removing the envelope is not shown. Corresponding devices are known as such, they may e.g. comprise a segment roller arranged below the plane defined by the main surface of the guide plate 34.

Figure 5A:
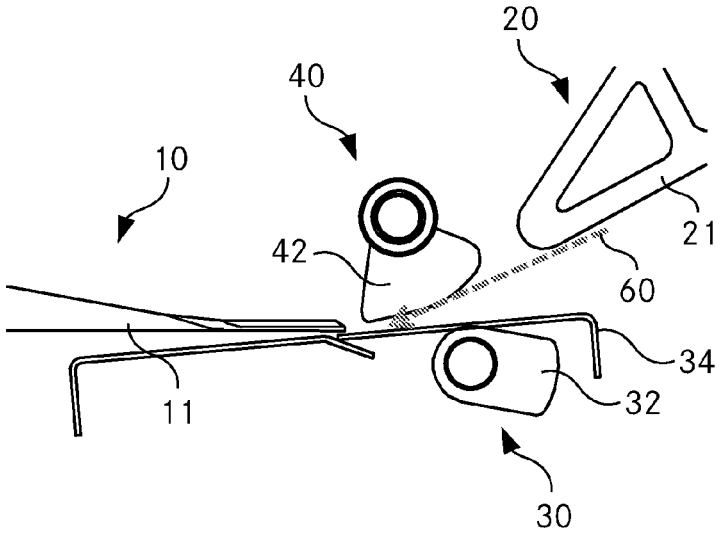
FIG. 5A-F the succession of steps of a mode of operation of the inventive device.

FIGS. 5A-F show the succession of steps of a mode of operation of the inventive device. FIG. 5A shows a first operating position for a first feeding phase of the envelope. The envelope feed path 60 is schematically shown by a dashed arrow. The cams 32 of the second interaction device 30 are rotated to a position where they are held below the guide plate 34. The envelope is guided between the finger 21 of the first interaction device 20 and the cams 42 of the third interaction device 40 on one side and the guide plate 34 on the other side. The cams 42 of the third interaction device 40 makes sure that the flap which is the first portion of the envelope being fed to the holding device 10 is fed to the underside of the blades 11, i.e. the side opposite the first and third interaction devices 20, 40.

Figure 5B:
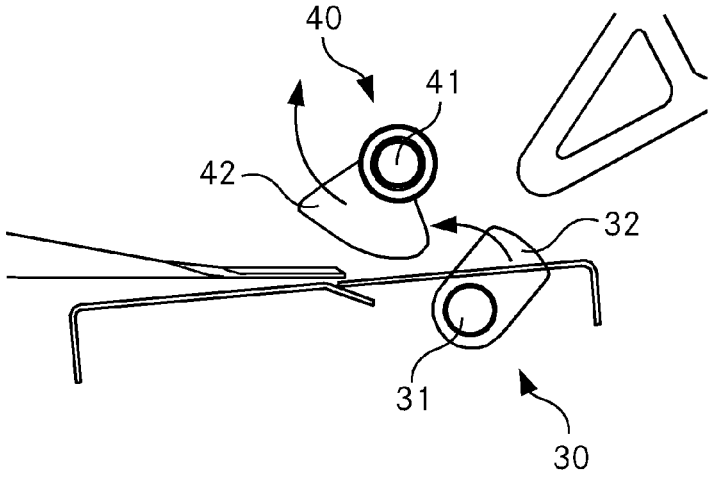

As soon as the flap is in contact with the blades 11 (including in particular the central blade which is not visible in the side view of FIG. 5A), the shafts 31, 41 of the second and third interaction devices 30, 40 are rotated as shown in FIG. 5B, in order to reach the second operating position for a second feeding phase of the envelope. The direction of rotation is such that the cams 32, 42 of both the interaction device 30, 40 move essentially in the feed direction of the envelope.

Figure 5C:
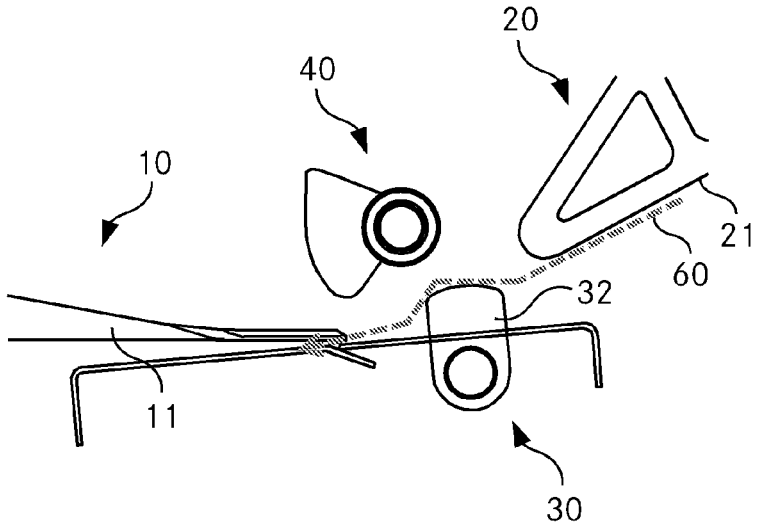

In the second operating position shown in FIG. 5C, the feed path 60 of the envelope is defined by the fingers 21 of the first interaction device 20, the cams 32 of the second interaction device 30 and the blades 11 of the holding device 10 (including in particular the central blade which is not visible in the side view of FIG. 5C) which are already in contact with at least the flap of the envelope. The impacts of these elements on the envelope lead to a characteristic deformation which opens up the envelope, thus facilitating the further feeding of the envelope to the holding device 10, in particular the introduction of the blades 11 in between the front and the back side of the envelope. The third interaction device 40 has no contact with the envelope in this operating position.

Figure 5D:
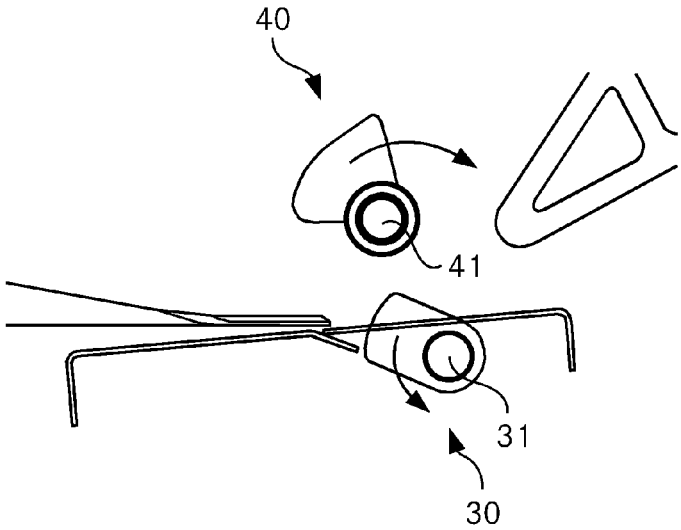
Figure 5E:
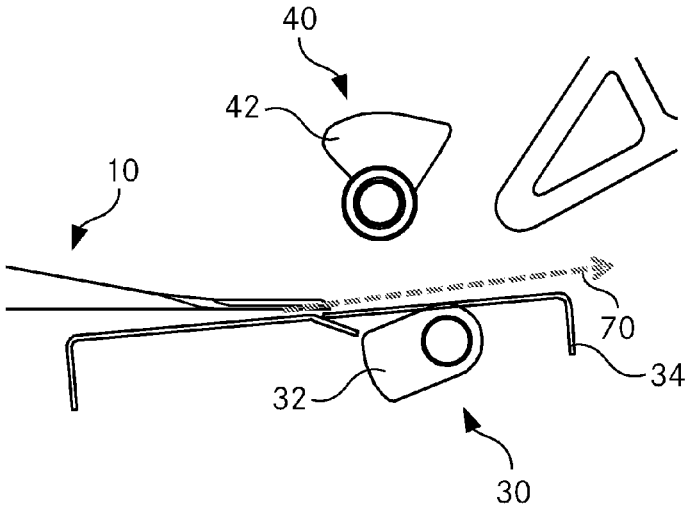

As soon as the blades 11 have been introduced in between the front and back side of the envelope, the shafts 31, 41 of the second and third interaction devices 30, 40 are rotated as shown in FIG. 5D, in order to reach the third operating position for a third feeding, filling and removal phase of the envelope, shown in FIG. 5E. The direction of rotation is the same as before, when moving from the first to the second operating position.

In the third operating position, none of the second and third interaction devices 30, 40 interferes with the feed path 60 and removal path 70 of the envelope: The cam 32 of the second interaction device 30 is held below the guide plate 34, whereas the cam 42 of the third interaction device 40 is facing away from the removal path 70. Accordingly, the filled envelope may be easily and rapidly removed from the holding device 10.

Figure 5F:
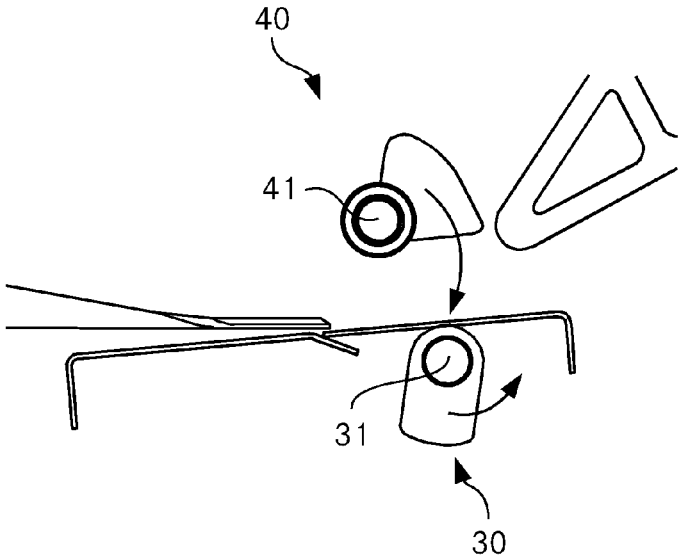

Next, as shown in FIG. 5F, the shafts 31, 41 of the second and third interaction devices 30, 40 are rotated in order to reach again the first operating position as shown in FIG. 5A. Again, the direction of rotation is the same as before, when moving from the first to the second and from the second to the third operating position.

It is to be noted that in the context of the described embodiment, the rotational movements of the second and third interaction devices 30, 40 have the sole purpose of ensuring the transition between the different operating positions. In particular, it is not the purpose of the rotational movements to impart motion to the envelope. This task is accomplished by specific feed and removal devices as mentioned above.

The operation of the second and third interaction devices 30, 40 is based on the output of sensors monitoring the progress of the envelope. In particular, the transition from the first to the second operating position may be triggered as soon as it is detected that the flap is in contact with all the blades 11, 15. The transition from the second to the third operating position may be triggered as soon as it is detected that all the blades 11, 15 have been introduced in between the front and back side of the envelope. Finally, the transition from the third to the first operating position may be triggered as soon as the filled envelope has left the interaction region of the second and third interaction device. Basically, all these events relate to a certain feed or removal position of the envelope, i.e. sensors may be employed that detect this feed or removal position.

The invention is not limited to the preferred embodiment described above. Many elements of the device may be embodied differently. In particular, the geometry of the components may differ from that of the described components. The guide fingers of the first interaction device may be fixed as shown above, but they may also be movable, in particular along a substantially vertical path. Furthermore, instead of or in addition to the guide fingers, the first interaction device may include other elements such as cams, guide plates, etc. As mentioned above, it is not required that the third interaction device comprises rotatable elements but it can also be oscillating, in particular along a substantially vertical path. In this case, guide plates or fingers may be employed instead of cams.

The shown embodiment may be oriented essentially upside down, i.e. the flap is on the upper side of the envelope fed onto the holding device. Accordingly, the geometry of the holding device and the geometry and position of the interaction devices is flipped upside down.

Furthermore, it is possible to have only two operating positions of the second and third interaction devices or more than three. It is also possible to drive the two shafts of these interaction devices in a (quasi-)continuous way. Similarly, it is possible to employ the rotational movement of the second and/or third interaction device to impart motion to the envelope, in contrast to the embodiment described above.

In summary, it is to be noted that the invention provides a device and a method for inserting sheets into an envelope that allow for high processing speeds and minimize adjustment needs.

The invention claimed is:

1. A device for inserting sheets into an envelope, comprising:

a) a holding device for supporting the envelope during insertion of the sheets into the envelope, when a support portion of the holding device is inserted into the envelope in between a front side of the envelope and a back side of the envelope;

b) a feed device for feeding the envelope to the holding device;

c) wherein the support portion of the holding device has a fixed orientation and position relative to the feed device and maintains this fixed orientation during feeding of the envelope, insertion of the sheets and removing of the envelope respectively; and d) a mechanism for preparing the envelope for accommodating the support portion of the holding device, the mechanism being arranged upstream of the holding device and comprising a first interaction device, acting onto the envelope in a first direction during feeding of the envelope;

a second interaction device arranged downstream of the first interaction device, acting onto the envelope in a second direction during feeding of the envelope, the second direction being essentially opposite to the first direction;

wherein the second interaction device comprises at least one cam on a rotatable shaft, wherein by rotation of the shaft the at least one cam may be brought into an interaction position, where the cam interacts with the envelope, and into an inactive position, where the cam does not interact with the envelope.

2. The device as recited in claim 1, characterized in that the first interaction device has a fixed orientation and position relative to the feed device and the support portion of the holding device during feeding of the envelope, insertion of the sheets and removing of the envelope respectively.

3. The device as recited in claim 1, characterized in that the first direction is essentially perpendicular to a main surface of the fed envelope and points to the front side of the envelope.

4. The device as recited in claim 1, characterized in that an interaction region of the at least one cam of the second interaction device extends over essentially the whole maximum width of envelopes processed with the device.

5. The device as recited in claim 1, characterized in that the at least one cam of the second interaction device comprises a plurality of spaced cams.

6. The device as recited in claim 5, characterized by a guide plate comprising a plurality of slots, the guide plate and the second interaction device arranged such that the plurality of spaced cams penetrate the plurality of slots in the interaction position.

7. The device as recited in claim 1, characterized in that the mechanism for preparing the envelope comprises a third interaction device arranged downstream of the first interaction device, acting onto the envelope in the first direction, wherein the third interaction device may be brought into an interaction position, where it interacts with the envelope, and into an inactive position, where it does not interact with the envelope.

8. The device as recited in claim 7, characterized in that the third interaction device comprises at least one cam on a rotatable shaft, wherein by rotation of the shaft the cam may be brought from the inactive position into the interaction position.

9. The device as recited in claim 1, characterized in that the holding device comprises at least two lateral blades for supporting the envelope in lateral edge regions thereof.

10. The device as recited in claim 9, characterized in that the at least two lateral blades are adjustable in a cross direction in order to adapt the device to envelopes of different dimensions.

11. The device as recited in claim 10, characterized in that the holding device further comprises a third central blade for supporting the envelope in a central region.

12. The device as recited in claim 9, characterized in that the holding device further comprises a third central blade for supporting the envelope in a central region.

13. The device as recited in claim 12, characterized in that the lateral blades and the central blades each comprise a main portion, the blades being arranged such that the main portions are arranged essentially in a common plane, and in that the lateral blades each comprise a separation part extending from the main portion in the second direction, and in that the central blade comprises a separation part extending from the main portion in the first direction.

14. A method for inserting sheets into an envelope, comprising the steps of:

a) feeding the envelope in a feed direction;

b) during feeding of the envelope acting onto the envelope in a first direction by a first interaction device;

c) rotating a rotatable shaft of a second interaction device, the shaft having at least one cam, into an interaction position, the rotational shaft being arranged downstream of the first interaction device;

d) during feeding of the envelope acting onto the envelope by the cam in a second direction, the second direction being essentially opposite to the first direction;

e) further feeding the envelope such that a support portion of a holding device is inserted into the envelope in between a front side of the envelope and a back side of the envelope;

f) rotating the shaft of the second interaction device such that the at least one cam does not interact with the envelope anymore; and g) after filling of the envelope removing the envelope from the holding device in a direction essentially opposite to the feed direction.

15. The method as recited in claim 14, comprising the further steps of:

a) prior to a downstream end of the envelope contacting the support portion of the holding device, acting onto the envelope in the first direction by a third interaction device arranged downstream of the first interaction device; and b) after a downstream end of the envelope has contacted the support portion of the holding device and prior to the rotatable shaft of the second interaction device having reached the interaction position, positioning the third interaction device in an inactive position, where it does not interact with the envelope.

* * * * *